US006199725B1

(12) United States Patent
Garibaldi

(10) Patent No.: US 6,199,725 B1
(45) Date of Patent: Mar. 13, 2001

(54) AUTOMATICALLY CLOSING STOPPER FOR DISPENSING LIQUIDS FROM DEFORMABLE CONTAINERS

(75) Inventor: Giuseppe Garibaldi, Colnago (IT)

(73) Assignee: Capsol SpA - Stampaggio Resine Termoplastiche, Colnago (IT)

( * ) Notice: Subject to any disclaimer, the term of this patent is extended or adjusted under 35 U.S.C. 154(b) by 0 days.

(21) Appl. No.: 09/557,162

(22) Filed: Apr. 25, 2000

(30) Foreign Application Priority Data

Jun. 11, 1999 (IT) ..... MI99A1312

(51) Int. Cl.[7] ..... B65D 37/00
(52) U.S. Cl. ..... 222/207; 222/212; 222/494
(58) Field of Search ..... 222/207, 212, 222/494, 562, 490

(56) References Cited

U.S. PATENT DOCUMENTS 1,977,227 10/1934 Berendet .
5,033,655 * 7/1991 Brown ..... 222/494
5,052,594 * 10/1991 Sorby ..... 222/490
5,409,144 4/1995 Brown .
5,833,123 * 11/1998 Gueret ..... 222/494

* cited by examiner

*Primary Examiner*—Philippe Derakshani
(74) *Attorney, Agent, or Firm*—Oblon, Spivak, McClelland, Maier & Neustadt, P.C.

(57) ABSTRACT

An automatically closing dispenser stopper applicable to deformable containers for liquids, the stopper being constructed of plastic material and dispensing the liquid when the container is squeezed or deformed with the stopper facing downwards, the stopper closing automatically to form a seal when the compression exerted on the outside of the container ceases, this the tending to elastically recover its initial shape to put the liquid contained in it under vacuum and hence cause the stopper to close automatically.

2 Claims, 2 Drawing Sheets

AUTOMATICALLY CLOSING STOPPER FOR DISPENSING LIQUIDS FROM DEFORMABLE CONTAINERS

This invention relates to an automatically closing stopper for dispensing liquids from deformable containers.

Many liquid substances (for example soap solutions for personal hair washing) are contained in containers having a stopper which isolates the liquid from contact with air and prevents it from being involuntarily poured out.

In most cases the container normally rests on its base with its stopper facing upwards. When liquid is to be withdrawn for use, the container is inverted so that its (previously opened) stopper faces downwards.

In such container the liquid substances (which has a certain density and viscosity) collects on the container base when at rest, which means that a certain time is required before it reaches the stopper, to be dispensed from there to the outside (also because such substances tend to adhere to the container walls).

To facilitate emergence of the liquid substance from such containers they are increasingly constructed of deformable plastic, so that the container can be deformed and squeezed with one hand by the user to expel the substance from the container. Again in this case there remains the problem of the liquid substance collecting on the container base when at rest, with a fairly lengthy time being required to dispense the substance.

Moreover a not negligible part of the substance remains adhering to the container side walls in proximity to its base, with the consequence that the user (not having the patience to wait through the lengthy time required for dispensing to occur after his decision to use the liquid substance) disposes of the container while it still contains a useful amount of liquid substance.

More recently, containers have been proposed which when at rest are positioned with their dispensing stopper facing downwards, so preventing the liquid substances accumulating on the container base. The dispensing stoppers of these containers are essentially of two types, in the first and more simple of which the stopper is open and closed merely by a cover to be superposed on the discharge hole, whereas in the second the stopper comprises a unidirectional valve enabling the liquid substance to emerge from the container only when the container containing the substance is squeezed and deformed manually, the valve closing automatically on cessation of the pressure exerted on it by the compressed liquid in the container, which tends to return elastically to its rest state with corresponding cessation of pressure on its contained liquid as soon as the squeezing action on the container ceases.

In the first of the two aforesaid cases the liquid can leak or drip while the cover is being closed or opened (given that the stopper faces downwards when at rest and is hence full of liquid) with consequent external soiling of the stopper and container by the liquid. In the second case the dispensing valve does not provide an effective seal when at rest unless it is of very complex and costly structure, with compression springs acting on retention balls or the like.

The U.S. Pat. No. 1,977,227 discloses a self-closing head for paste tubes comprising a plurality of separate conical jaw sections contacting with each other at their bases and being separated from each other above the bases by tapering slits, the upper ends of said sections being cut out to leave an opening at the apex of the assembled cone. All the surfaces of the assembled jaw sections are covered with a layer of rubber binding such sections together into a single unit, a cut being provided into the rubber through said opening to permit ribbon of paste to emerge therefrom against the restraining force of the rubber coating when pressure is applied to the tube filled with the paste. As it can be easily understood the above mentioned self-closing head has a very complex structure making it really expensive.

The main object of the invention is to provide a dispensing stopper for liquids contained in deformable containers which opens to leave liquids to be easily dispensed when the containers are squeezed and respectively which automatically closes into a sealed state when the squeezing action ceases, the stopper being of very simple and economical structure, of easy construction in that all its components can be plastic-moulded, and of very reliable operation.

This and further objects are attained by a stopper comprising a profiled body sealedly applicable to the mouth of a container and having a hole for housing a valve is formed in one piece of deformable moulded material, characterised in that said valve is of elongate form and comprises an annular body and at least four separate flexible appendices projecting from the same side of the annular body and having one end free and their other end or base rigid with the annular body, those sides of each appendix which face the sides of the appendices adjacent to it being defined by smooth surfaces which are substantially specular to each other and sealedly rest against each other when the valve is closed, said hole in the profiled body being bounded by an annular wall which interferes with the outer surfaces of said appendices in correspondence with their bases, to urge their smooth surfaces against each other and form a seal between them, so closing said valve when in its rest state.

Preferably said smooth surfaces consist of flat surfaces defining those sides of each appendix facing analogous sides of the appendices adjacent to it, and from each appendix there outwardly projects a longitudinal rib, a cover being provided to be superposed on said appendices to interfere with their longitudinal ribs and press the smooth surfaces of the appendices against each other to provide sealed mechanical closure of the valve.

The structure and operation of the stopper according to the invention will be apparent from the description of one embodiment thereof given hereinafter by way of non-limiting example with reference to the accompanying drawings, on which:

FIGS. 2, 3, 4 show the end of a container 1 of deformable plastic material (for example polyethylene, polypropylene, PVC or PET) having a mouth 2 on which an automatically closing stopper forming the subject of the invention has been sealedly applied.

Figure 1:
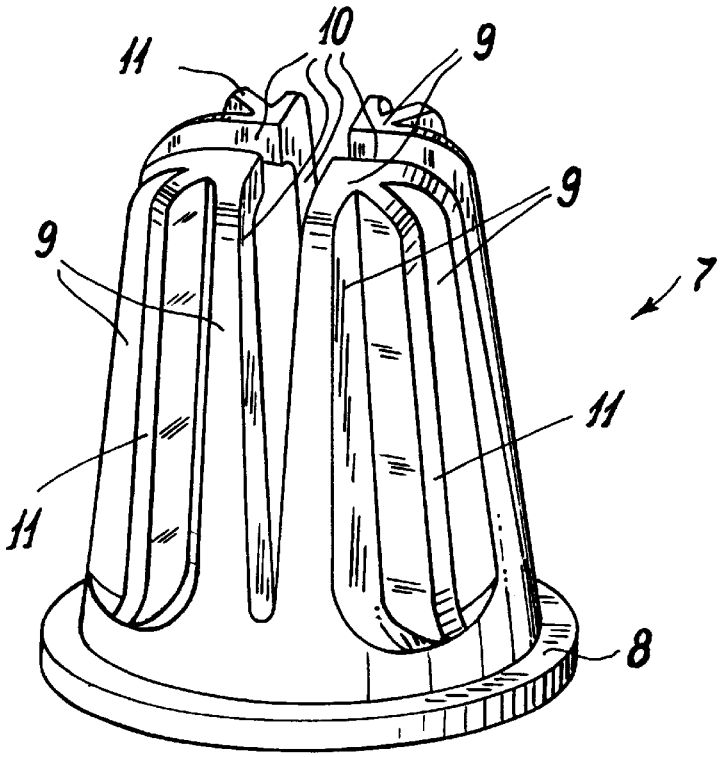
FIG. 1 is a perspective view of the valve forming part of the stopper.
Figure 2:
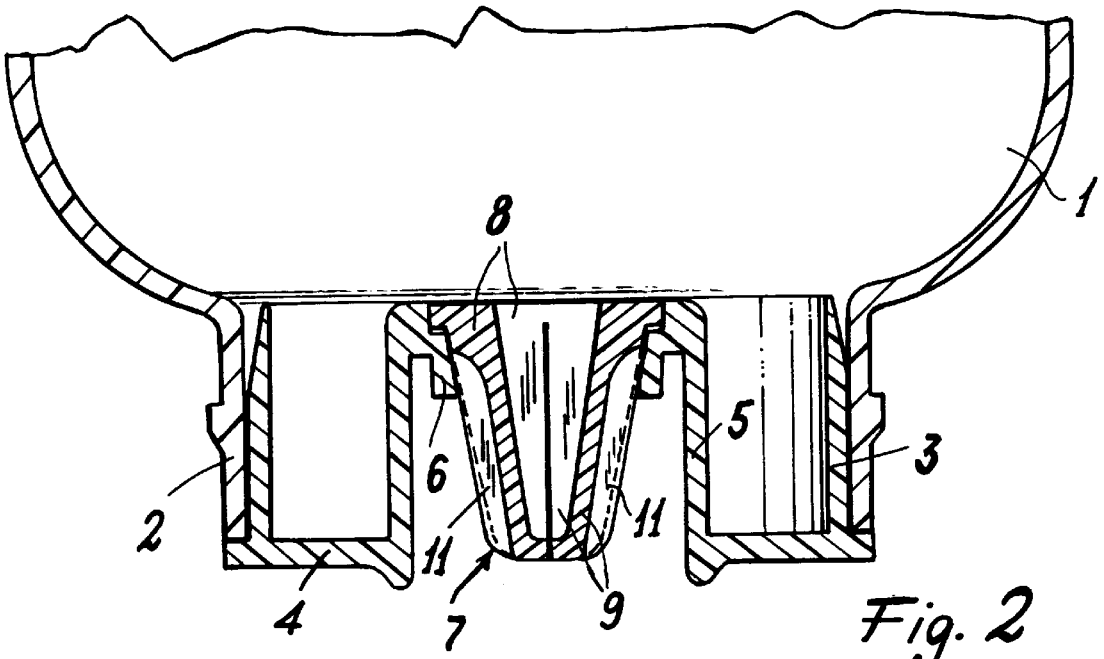
FIG. 2 is a longitudinal section to an enlarged scale taken through that end portion of a container on which a stopper shown in its closed position is applied.
Figure 3:
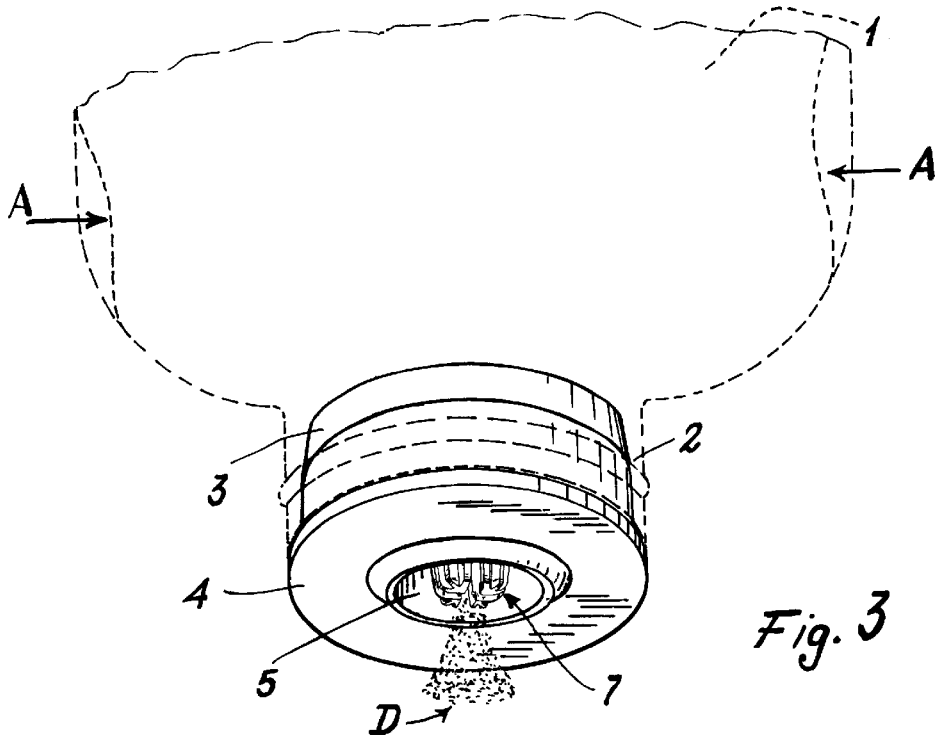
FIG. 3 is a perspective view of a portion of the container and the stopper, shown during liquid dispensing.

The stopper comprises a profiled body (for example of polypropylene construction) bounded laterally by an outer cylindrical wall 3 (sealedly inserted into the hole in the container mouth) and formed in one piece with a flat wall 4 and an inner cylindrical wall 5, of which there forms part an annular wall 6 bounding a hole into which a valve 7 shown in perspective view in FIG. 1 and in section in FIGS. 2 and 3 is pressure inserted and retained.

The valve 7 (produced by moulding an elastically deformable material such as polyethylene or elastomer) is in the shape of an elongate dome and comprises an annular body 8 from which four separate flexible appendices 9 extend.

Those sides 10 of each appendix which face the sides of the appendix adjacent to it are relatively large and are defined by flat smooth surfaces which are specular to each other and are spaced apart (FIG. 1) within the valve as produced in the mould. However, these sides sealedly rest against each other when the valve is mounted on the profiled body 3-6 and is in its rest state (FIGS. 2, 4, 5).

Figure 4:
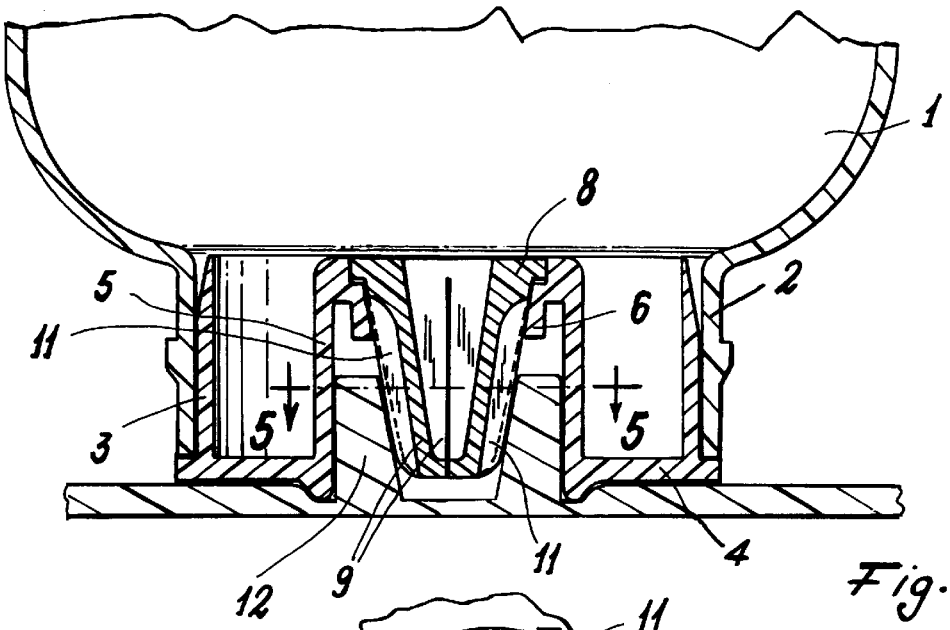
FIG. 4 is similar to FIG. 2, and shows a cover applied to the stopper to maintain the valve of which it forms part mechanically closed.
Figure 5:
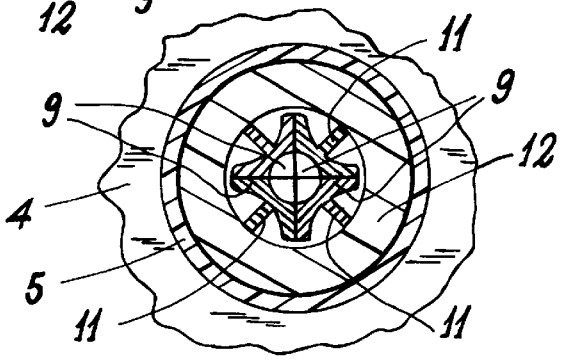
FIG. 5 is a partial cross-section through the stopper and its mechanical closure cover, taken on the line 5—5 of FIG. 4.

In this respect, when the valve 7 is inserted into the hole in the profiled body, the annular wall 6 interferes with the outer surface of the appendices 9 in correspondence with their bases (in proximity to the annular body 8 from which they project), causing them to flex inwards and urging the smooth surfaces of their sides against each other to form a seal between them, so closing the valve when in its rest state (FIGS. 2, 4, 5).

It will be assumed that the container 1 contains a liquid, that the described stopper has been applied to it and that the container is held in the position shown in FIG. 2, with the stopper facing downwards. Under these conditions, the pressure exerted by the annular wall 6 on the base of the appendices 9 is sufficient to seal the valve hermetically and to hence prevent liquid emerging from the valve, even if this faces downwards.

It will now be assumed that the container 1 is squeezed with one hand to deform it in the direction indicated by the arrows A in FIG. 3. As a consequence of this deformation the liquid present in the container is pressurized to cause the valve to open by flexing the flexible appendices 9 outwards, to enable a quantity of liquid to emerge, as indicated by the letter D and represented as a dotted cone in FIG. 3.

As soon as the application of manual pressure to the outside of the container 1 ceases, this latter tends to elastically recover its initial position, to hence put the space and the liquid enclosed within it under vacuum. This causes the appendices 9 to automatically return to their initial rest position, in which the valve is sealedly closed, and there is no dripping or emergence of the liquid even if the container is maintained with its stopper facing downwards.

If mechanical valve closure is also desired, a longitudinal rib 11 can be provided projecting outwards from each appendix 9. In this case, a cover 12 (FIGS. 4 and 5) can be inserted into the inner cylindrical wall 5 of the stopper, to act on the outer surface of the ribs 11 and press the smooth surfaces of the appendices 9 against each other to provide mechanical sealed closure of the valve.

What is claimed is:

1. An automatically closing stopper for dispensing liquids from deformable containers, comprising a profiled body sealedly applicable to the mouth of a container and having a hole for housing a valve, wherein said valve is formed in one piece of deformable moulded material, is of elongate form and comprises an annular body and at least four separate flexible appendices projecting from the same side of the annular body and having one end free and their other end or base rigid with the annular body, those sides of each appendix which face the sides of the appendices adjacent to it being defined by smooth surfaces which are substantially specular to each other and sealedly rest against each other when the valve is closed, said hole in the profiled body being bounded by an annular wall which interferes with the outer surfaces of said appendices in correspondence with their bases, to urge their smooth surfaces against each other and form a seal between them, so closing said valve when in its rest state wherein from each appendix there outwardly projects a longitudinal rib, a cover being provided to be superposed on said appendices to interfere with their longitudinal ribs and press the smooth surfaces of the appendices against each other to provide sealed mechanical closure of the valve.

2. A stopper as claimed in claim 1, wherein said smooth surfaces consist of flat surfaces defining those sides of each appendix facing analogous sides of the appendices adjacent to it.

* * * * *